US006779236B2

(12) United States Patent
Fehrer

(10) Patent No.: US 6,779,236 B2
(45) Date of Patent: Aug. 24, 2004

(54) APPARATUS FOR NEEDLING AT LEAST ONE YARN

(76) Inventor: Monika Fehrer, Wegscheider Strasse 15, A 4060 Leonding (AT)

( * ) Notice: Subject to any disclaimer, the term of this patent is extended or adjusted under 35 U.S.C. 154(b) by 0 days.

(21) Appl. No.: 10/659,953

(22) Filed: Sep. 11, 2003

(65) Prior Publication Data

US 2004/0050116 A1 Mar. 18, 2004

(30) Foreign Application Priority Data

Sep. 12, 2002 (AT) ..... 1361/02

(51) Int. Cl.[7] ..... D04H 18/00
(52) U.S. Cl. ..... 28/107; 28/247
(58) Field of Search ..... 28/107, 108, 109, 28/110, 111, 112, 113, 114, 115, 247, 219, 103, 165, 299, 100; 57/202, 22, 23

(56) References Cited

U.S. PATENT DOCUMENTS 3,208,125 A * 9/1965 Hall et al. ..... 28/219
3,230,599 A * 1/1966 McKew et al. ..... 28/110
4,674,271 A * 6/1987 Bird ..... 57/2
5,081,753 A * 1/1992 Fink et al. ..... 28/219
5,390,399 A * 2/1995 Dilo ..... 28/109
5,473,802 A * 12/1995 Dilo ..... 28/107
5,758,394 A * 6/1998 Linck et al. ..... 28/107
5,813,101 A * 9/1998 Fehrer ..... 28/114
5,819,383 A * 10/1998 Jourde et al. ..... 28/107
5,893,200 A * 4/1999 Fehrer ..... 28/115
6,305,058 B1 * 10/2001 Fehrer ..... 28/107
6,311,375 B1 * 11/2001 Patrick ..... 28/253
2001/0049869 A1 * 12/2001 Fehrer ..... 28/107
2002/0038499 A1 * 4/2002 Fehrer ..... 28/219
2003/0097740 A1 * 5/2003 Jourde et al. ..... 28/107

FOREIGN PATENT DOCUMENTS

DE 101 28 495 A1 2/2002
DE 101 38 701 A1 4/2002
DE 101 47 188 A1 5/2002

* cited by examiner

*Primary Examiner*—Amy B. Vanatta
(74) *Attorney, Agent, or Firm*—Collard & Roe, P.C.

(57) ABSTRACT

An apparatus is described for needling at least one yarn (16) with at least one needle board (4) which is reciprocatable in the needling direction, with a stitch base (1) which is disposed opposite of the needle board (4) and is made of an endlessly revolving brush belt (3), and with a stripper (5) which is disposed between the stitch base (1) and the needle board and which forms at least one guide duct (9) for the yarn (16) extending in the revolving direction (10) of the brush belt (3) and comprises in the region of said guide duct (9) pass-through openings (20) for the needles (8) of the needle board (4). In order to provide advantageous needling conditions it is proposed that the guide duct (9) is provided between guide walls (15) engaging in the brush belt (3), which guide walls delimit a duct cross section which tapers towards the yarn (16) in the region of the brush engagement.

3 Claims, 2 Drawing Sheets

APPARATUS FOR NEEDLING AT LEAST ONE YARN

FIELD OF THE INVENTION

The invention relates to an apparatus for needling at least one yarn with at least one needle board which is reciprocatable in the needling direction, with a stitch base which is disposed opposite of the needle board and is made of an endlessly revolving brush belt and a stripper which is disposed between the stitch base and the needle board and which forms at least one guide duct for the yarn extending in the revolving direction of the brush belt and comprises in the region of said guide duct pass-through openings for the needles of the needle board.

DESCRIPTION OF THE PRIOR ART

In order to bond yarns and to secure them against untwisting it is known to needle the yarns in such a way that the yarns are pulled on a stitch base within guide ducts along their length through the needling device and are penetrated by the needles which pull fiber loops transversally to the longitudinal direction of the yarn and thus fix the yarn twist on the one hand and produce a yarn bonding on the other hand. As a result of fibers which are pulled out of the fiber structure transversally to the longitudinal direction of the yarn it is also possible to produce fancy yarns which are characterized for example by special hairiness or an enlarged volume. In order to produce such yarns the stitch bases in the form of brush belts are the obvious choice as are used in the needling of velour felt. It has been seen however that under certain circumstances not only the fibers pulled out of the yarn structure are needled in the brush belt between the bristles of the brush belt but also the yarns per se, which impairs the formation of a fibrous web by fiber loops pulled out of the yarn structure and entails difficulties in the detachment of the needled yarn from the brush belt.

SUMMARY OF THE INVENTION

The invention is thus based on the object of providing an apparatus for needling fancy yarns by needling-induced extraction of fiber loops from the yarn structure without endangering the yarn guidance on the surface of the stitch base.

Based on an apparatus of the kind mentioned above, the invention achieves this object in such a way that the guide duct is provided between guide walls engaging in the brush belt, which guide walls delimit a duct cross section which tapers towards the yarn in the region of the brush engagement.

Since as a result of this measure the guide walls delimiting the guide duct engage in the brush belt and lead the bristles of the brush belt together towards the yarn due to the tapering cross section of the duct, the bristles of the brush belt form a comparatively dense support for the yarn in the region of the guide duct. Although it allows the needling in of fibers from the fiber structure of the yarn for forming a web, it substantially prevents a penetration of the yarn into the brush belt. The bristles of the brush belt which are pushed together in the support region of the yarn are supported by the guide walls and are therefore unable to yield transversally to the revolving direction of the brush belt.

Since generally several yarns are needled parallel with respect to each other, it is provided for this case that the stripper comprises several guide ducts which are situated successively adjacent to one another and between which profiles are provided with a wedge-like shape for forming the guide walls. In order to ensure that these profiles are able to engage between the bristles of the revolving brush belt in a manner which protects the brush belt, the wedge-like profiles can comprise a sloping face side which on the feed side of the brush belt is arranged in the manner of a blade and slopes downwardly in the revolving direction of the brush belt, so that the bristles moved against the profiles are pushed apart on the face side arranged in the manner of a blade and the assemblage of bristles is divided according to the guide ducts of the stripper.

BRIEF DESCRIPTION OF THE DRAWINGS

The subject matter of the invention is shown by way of example in the drawings, wherein.

DESCRIPTION OF THE PREFERRED EMBODIMENTS

Figure 1:
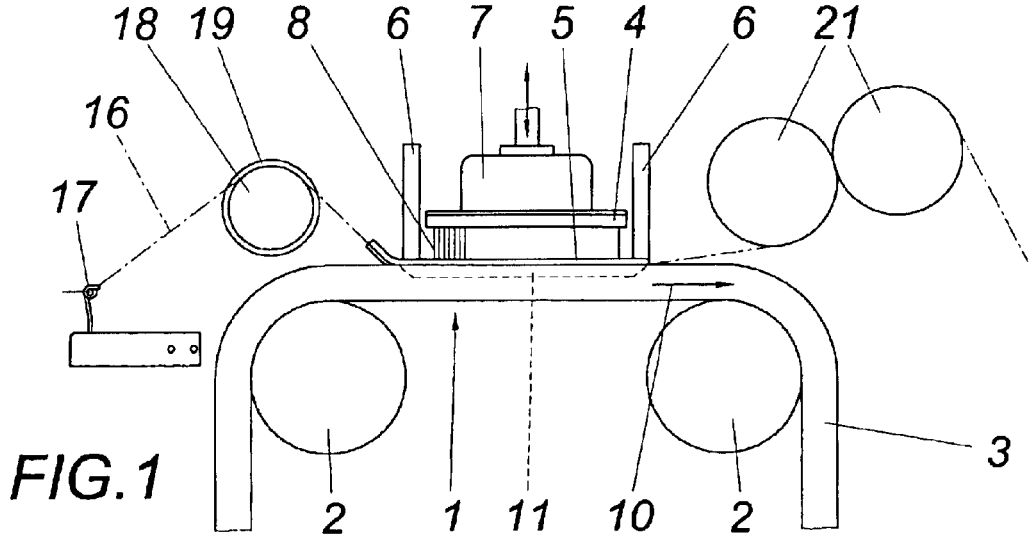
FIG. 1 shows a schematic side view of an apparatus in accordance with the invention for needling a yarn.

As is shown especially in FIG. 1, the illustrated apparatus substantially consists of a stitch base 1 which is formed by a brush belt 3 guided in an endless way about deflection rollers 2, of a needle board 4 and of a stripper 5 which is disposed between the stitch base 1 and the needle board 4 and which is height-adjustable via supports 6. The needle board 4 which is inserted in a needle beam 7 in a conventional way is driven in a reciprocating manner in the needle-penetration direction of the needles 8 via the needle beam 7 by means of an eccentric drive.

Figure 2:
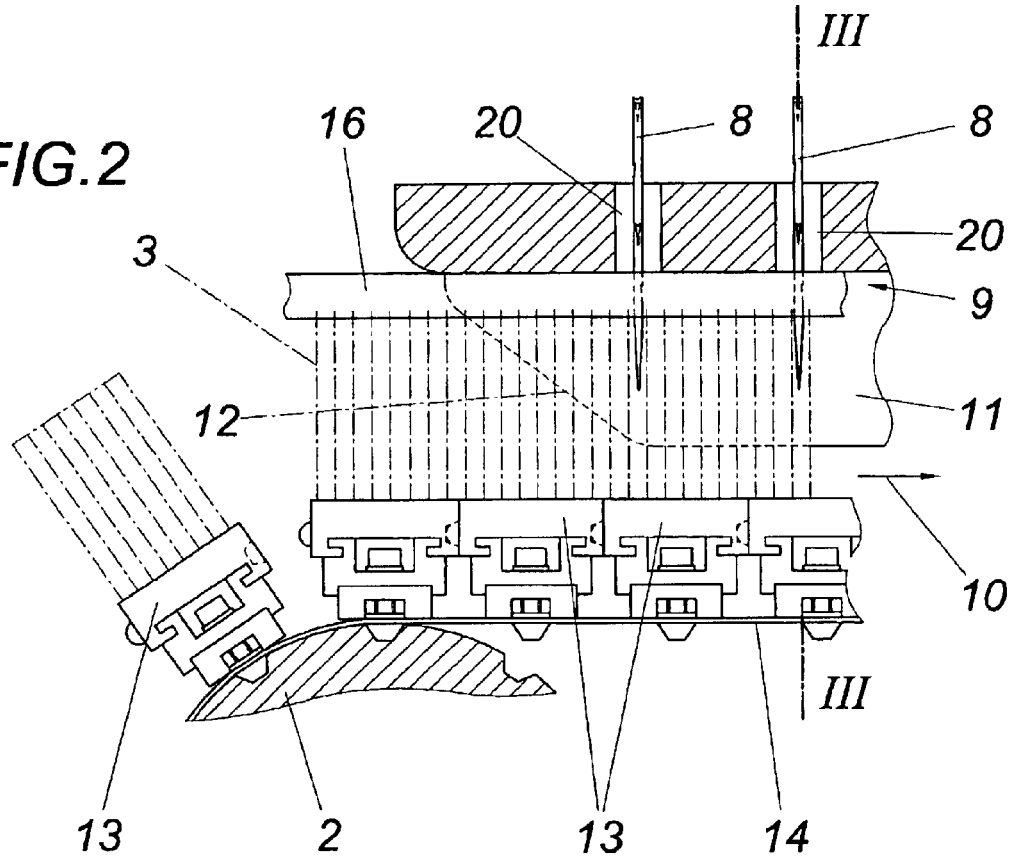
FIG. 2 shows said apparatus in a longitudinal sectional view on an enlarged scale in the region of the stripper.
Figure 3:
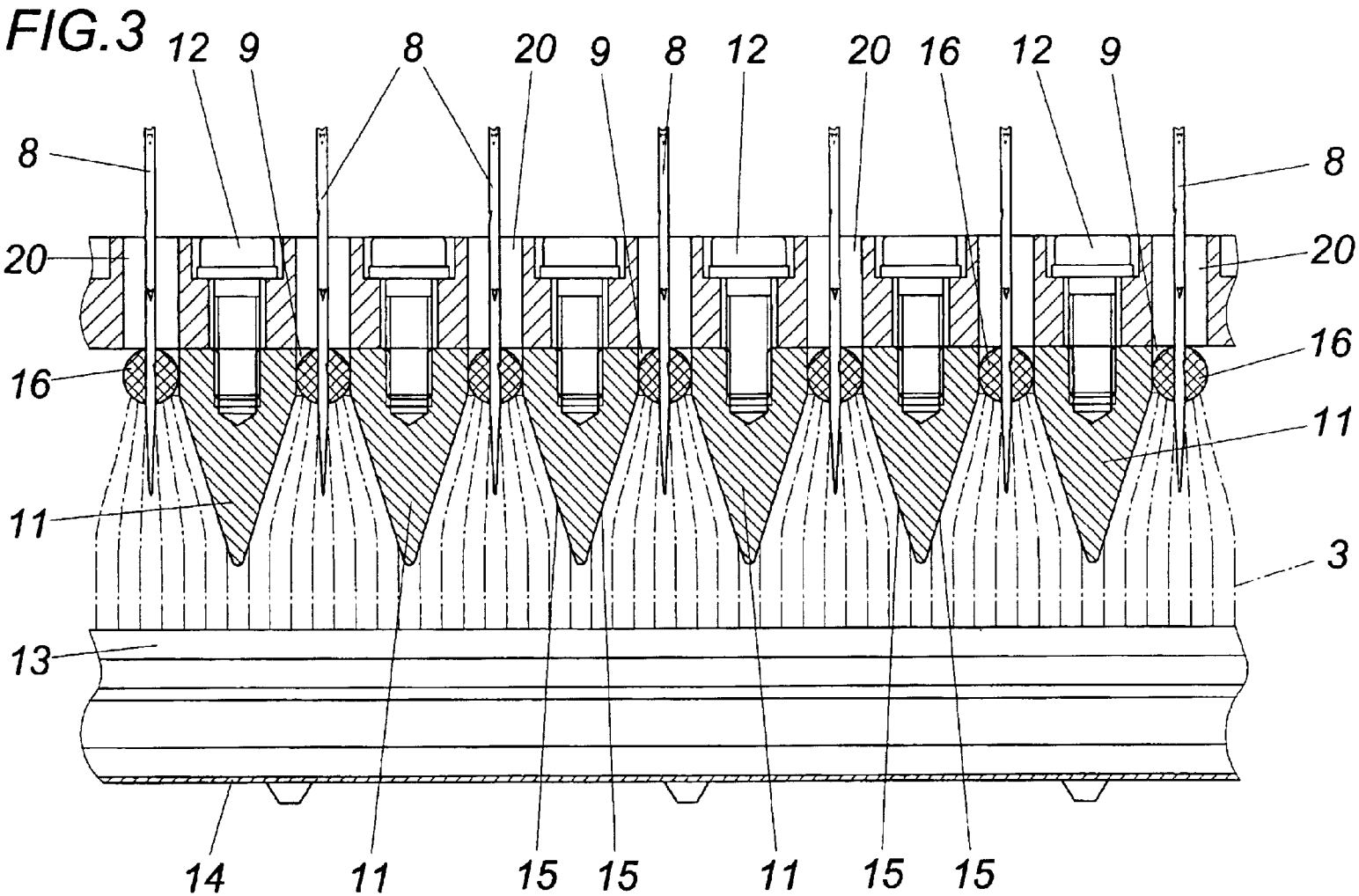
FIG. 3 shows a sectional view along line III—III of FIG. 2 on an enlarged scale.

Guide ducts 9 which are situated successively next to each other are provided on the side of the stripper 5 which faces the brush belt 3, which guide ducts extend in the revolving direction 10 of the brush belt 3, as is shown in particular in FIG. 3. Said guide ducts 9 are formed between profiles 11 which are wedge-like in their cross section and are fastened to stripper 5 by means of screws 12. According to FIG. 2, said profiles form a blade-like configured edge 12 which slopes downwardly in the revolving direction 10 of the brush belt 3 in the region of the face side on the feed side.

The brush belt 3 is composed of individual brush plates 13 which are fastened to a traction means 14 guided over the deflection rollers 2. When the brush plates of the revolving brush belt 3 are moved against the stripper 5 which is set against the stitch base 1 and whose profiles 11 engage in the bristle trimming of the brush plates 13, the assemblage of bristles which is moved towards the cutting edges 12 is divided according to the guide ducts 9. The guide walls 15 which are formed by the profiles 11 and which determine the duct cross section tapering towards the stripper 5 push together the bristles in the region of their free ends, as is indicated in FIG. 3. The yarns 16 to be needled are therefore provided with a secure support on the bristles within the guide ducts 9 without encountering the likelihood of being needled into the brush belt 3. The bristles are incapable of yield laterally due to the profiles 11. The web-forming needling in of fiber loops from the fiber structure of the yarns 16 into the brush belt is thus not impaired.

In order to needle the yarns 16, they are withdrawn from supply coils and supplied via guide eyes 17 of a drawing-in roller 18 which comprises guide grooves 19 which are aligned relative to the guide ducts 9 of stripper 5 and extend perpendicularly to its axis. The yarns 16 running from the drawing-in roller 18 into the needling apparatus are needled in within the guide ducts 9 by needles 8 which penetrate the stripper in the region of the guide ducts 9 in pass-through holes 20 by forming a fibrous web on the needle exit side in the brush support formed by the brush belt 3 before they are lifted off from the brush belt 3 by a take-down device 21.

It is understood that the invention is not limited to the illustrated embodiment. The cross-sectional shape of the profiles 11 could be changed for example in order to provide special conditions concerning the support of the bristles and their displacement towards the center of the respective guide duct. Moreover, the penetration depth of the profiles 11 into the brush belt 3 can be adjusted according to the respective conditions.

What is claimed is:

1. An apparatus for needling at least one yarn with at least one needle board which is reciprocatable in a needling direction, with a stitch base which is disposed opposite of the needle board and is made of an endlessly revolving brush belt, and with a stripper which is disposed between the stitch base and the needle board and which forms at least one guide duct for the yarn extending in the revolving direction of the brush belt and comprises in the region of said guide duct pass-through openings for the needles of the needle board, characterized in that the guide duct (9) is provided between guide walls (15) engaging in the brush belt (3), which guide walls delimit a duct cross section which tapers towards the yarn (16) in the region of the brush engagement.

2. An apparatus as claimed in claim 1, characterized in that the stripper (5) comprises a plurality of guide ducts (9) which are situated successively adjacent to one another and between which profiles (11) are provided with a shape which is wedge-like in cross section for forming the guide walls (15).

3. An apparatus as claimed in claim 2, characterized in that the wedge-like profiles (11) comprise a face side which on the feed side of the brush belt (3) is arranged in the manner of a blade and slopes downwardly in the revolving direction (10) of the brush belt (3).

* * * * *